United States Patent [19]

Yost

[11] 4,092,754

[45] June 6, 1978

[54] BOAT INTERIOR AND CABIN DESIGN

[76] Inventor: John V. Yost, 2233 Riverside Dr., Trenton, Mich. 48183

[21] Appl. No.: 775,058

[22] Filed: Mar. 7, 1977

[51] Int. Cl.[2] ..... B63B 17/00

[52] U.S. Cl. ..... 9/1.1; 9/1.5; 114/71

[58] Field of Search ..... 9/1.1, 1.5, 6 R, 6 M, 9/6 P, 6 W, 6.5; 114/56, 71, 201 R; D12/62, 66, 67, 70; 135/6

[56] References Cited

U.S. PATENT DOCUMENTS

| | | | |
|---|---|---|---|
| 2,764,765 | 10/1956 | Woodruff, Sr. | 135/6 |
| 3,039,417 | 6/1962 | Hoffberg | 114/71 |
| 3,376,586 | 4/1968 | Forsyth et al. | 9/1.5 |
| 3,475,773 | 11/1969 | Codman, Jr. | 9/1.5 |
| 3,834,340 | 9/1974 | Thorpe | 114/201 R |

FOREIGN PATENT DOCUMENTS

| | | | |
|---|---|---|---|
| 1,287,268 | 8/1972 | United Kingdom | 135/6 |

*Primary Examiner*—Trygve M. Blix
*Assistant Examiner*—Stuart M. Goldstein
*Attorney, Agent, or Firm*—Clarence A. O'Brien; Harvey B. Jacobson

[57] ABSTRACT

A hull is provided defining longitudinal upstanding opposite sides interconnected by a bottom extending between lower marginal edges of the sides and by a bow structure at their forward ends and a transom structure at their rear ends. A pair of spaced apart midship opposite side compartments are provided immediately inwardly of the sides and define a center longitudinal aisle therebetween. A helm is disposed immediately rearward of one of the compartments and the sides terminate upwardly in generally horizontal gunwales. The compartments project upwardly appreciably above the gunwales and include forward upper portions inclined forwardly and downwardly toward the gunwales. A lower walk deck extends longitudinally of the hull between the compartments and appreciably forwardly of the latter. A raised deck is provided above and below the walk deck and gunwales, respectively, and extends between the sides forward of the compartments and forward from the latter toward the bow structure. The raised deck includes a rearwardly opening vertically extending recess formed therein opening into the aisle defined between the compartments and in vertical registry with the forward portion of the walk deck extending forwardly of the compartments. The portion of the interior of the hull disposed between the compartments and the bow and between the opposite sides of the hull defines a forward cockpit and a cover is removably secured over the cockpit.

9 Claims, 11 Drawing Figures

BOAT INTERIOR AND CABIN DESIGN

BACKGROUND OF THE INVENTION

Various forms of small boat hulls have been newly designed in order to provide varying boat hull interiors specifically adapted for individual purposes. In recent years the "bowrider" type of hull has been designed to increase seating capacity in smaller boat hulls and the "cuddy cabin" type of hull has also been recently designed to provide limited enclosed cabin space incorporating at least two sleeping bunks. Still further, a substantially totally open "fisherman" type of hull has been provided including an upstanding helm console and specifically designed for use by fishermen. However, no one hull has been provided adaptable to solve at least all three of these functions. Accordingly, a need exists for a boat hull which may alternately be used as a "bowrider", a "cuddy cabin" and a "fisherman".

Examples of previously known different forms of hull constructions including some of the general structural and operational features of the instant invention are disclosed in U.S. Pat. Nos. 1,879,681, 2,947,277, 3,161,895, 3,312,990, and 3,438,073.

BRIEF DESCRIPTION OF THE INVENTION

The hull of the instant invention is constructed in a manner to define a totally upwardly opening hull having a pair of spaced apart midship opposite side compartments immediately inwardly of the sides of the hull and defining a center longitudinal aisle therebetween. The compartments project considerably above the gunwales of the hull and include forward upper portions which are inclined forwardly and downwardly toward the gunwales. In addition, removable top structures are provided for closing the forward cockpit portion of the hull disposed forward of the opposite side compartments and the cover may be in the form of a flexible cover for a hard top cover. Each form of cover includes a top panel and depending opposite side panels. The rear marginal edge of the top panel is anchored relative to the upper portions of the opposite side compartments adjacent the upper ends of the forwardly and downwardly inclined upper forward portions of the compartments and the depending sides or panels of the cover include rearwardly and upwardly inclined marginal edges which are anchored relative to the remote marginal edges of the forwardly and downwardly inclined compartment portions. The forward marginal edge of the top panel is anchored relative to the bow structure of the hull and the lower marginal edges of the side panels at the top extending between the forward marginal edge of the top and the rearwardly and upwardly inclined marginal edges of the side panels of the top are anchored relative to the corresponding gunwales.

The hard or soft tops may be used to form a cuddy cabin or merely as a cover for the forward cockpit portion of the hull disposed forward of the opposite side compartments. In addition, the hard or soft top may be removed in order to transform the hull into a "bowrider" or into a "fisherman".

The main object of this invention is to provide a boat hull specifically designed to function well as at least three different designs of boats.

Another object of this invention, in accordance with the immediately preceding object is to provide a boat hull including additional storage and an enclosed compartment for a marine head or portable toilet.

Yet another object of this invention is to provide a boat hull in accordance with the preceding objects and which will be adaptable to its construction in lengths varying between 12 and 30 feet.

A final object of this invention to be specifically enumerated herein is to provide a boat hull in accordance with the preceding objects and which will conform to conventional forms of manufacture, be of simple construction and readily adaptable for various uses.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
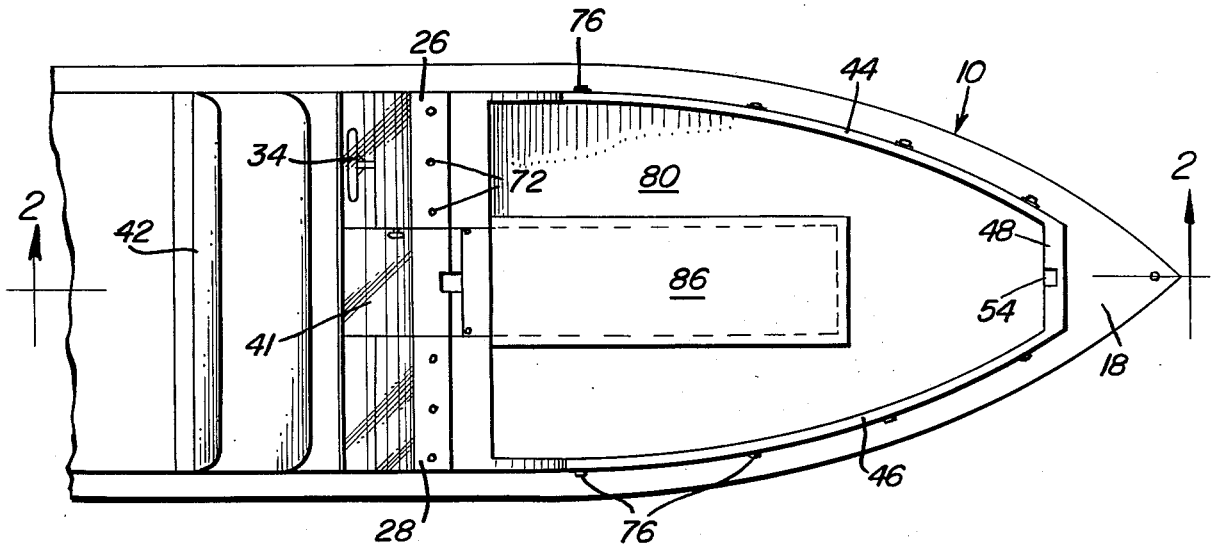
FIG. 1 is a fragmentary top plan view of a boat hull constructed in accordance with the present invention.
Figure 2:
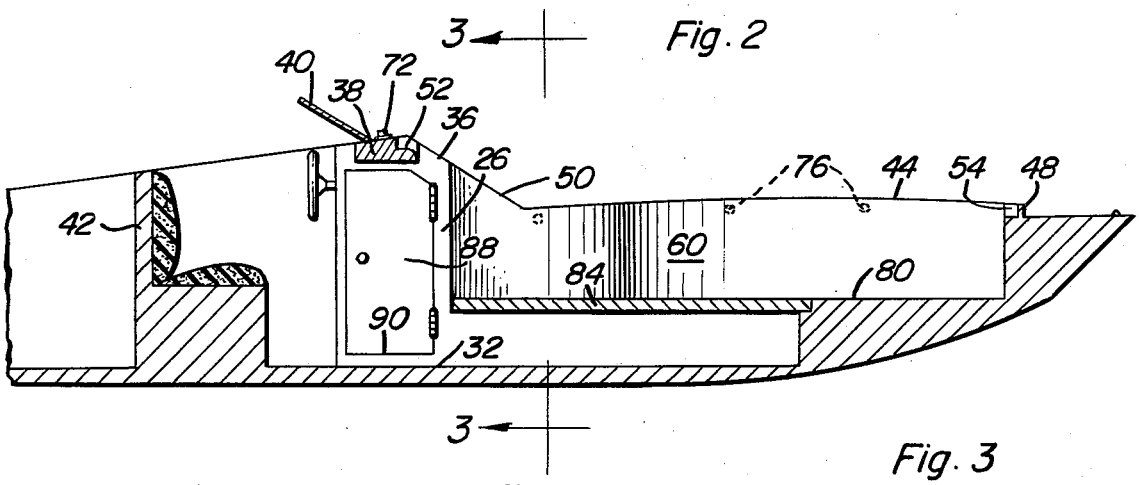
FIG. 2 is a longitudinal vertical section view taken substantially upon the plane indicated by the section line 2—2 of FIG. 1.
Figure 3:
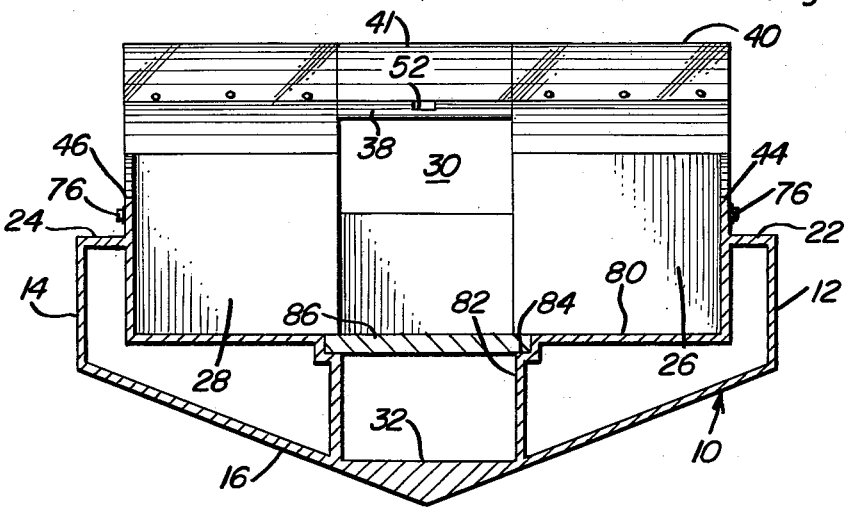
FIG. 3 is an enlarged transverse vertical sectional view taken substantially upon the plane indicated by the section line 3—3 of FIG. 2.
Figure 4:
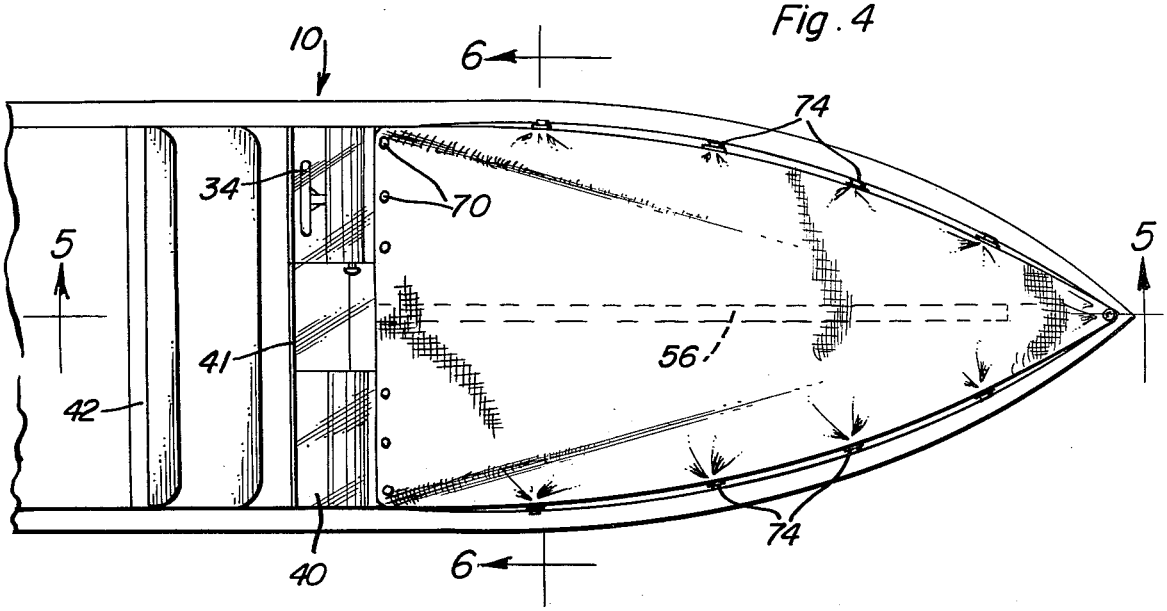
FIG. 4 is a fragmentary top plan view similar to FIG. 1 but with a soft top cover secured over the forward cockpit portion of the boat hull.
Figure 5:
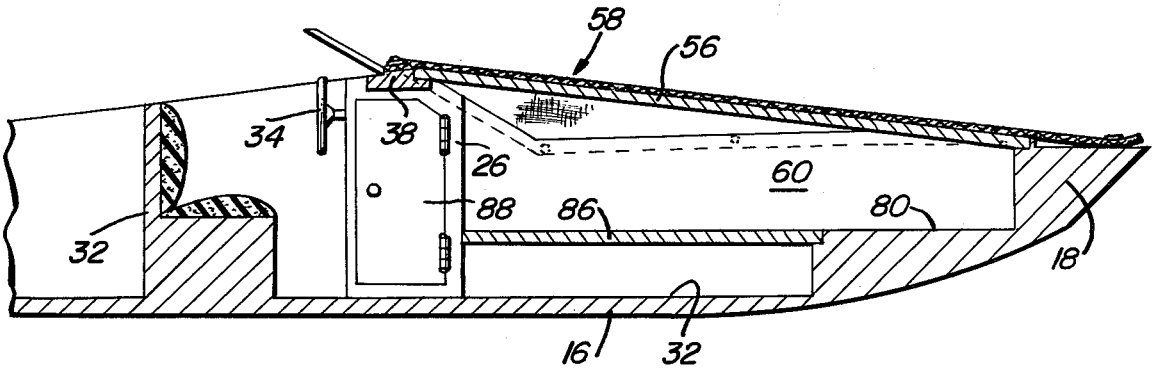
FIG. 5 is a longitudinal vertical sectional view taken substantially upon the plane indicated by the section line 5—5 of FIG. 4 and with a removal flooring section illustrated in position within the forward cockpit portion of the hull.
Figure 6:
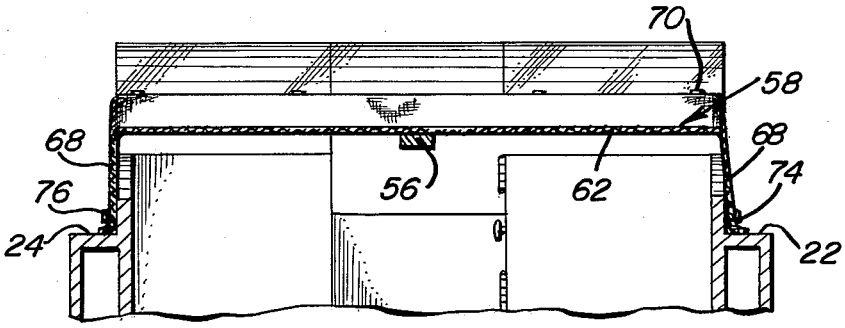
FIG. 6 is a fragmentary enlarged transverse vertical sectional view taken substantially upon the plane indicated by the section line 6—6 of FIG. 4.
Figure 7:
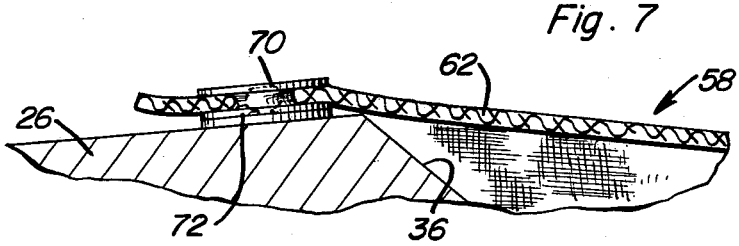
FIG. 7 is an enlarged fragmentary longitudinal vertical sectional view illustrating the manner in which the rear marginal edge of the soft top cover may be secured in position.

Referring now more specifically to the drawings, the numeral 10 generally designates a first form of boat hull constructed in accordance with the present invention. The hull 10 includes a pair of upstanding longitudinal sides 12 and 14 interconnected along their lower marginal edge portions by means of a longitudinally extending bottom structure 16. A forward bow structure 18 interconnects the forward ends of the sides 12 and 14 and the bottom structure 16 and the rear ends of the sides and the bottom structure are interconnected by means of a transom structure (not shown).

The sides 12 and 14 terminate upwardly in corresponding gunwale portions 22 and 24 and the interior of the hull 10 includes a pair of opposite side compartments 26 and 28 disposed immediately inwardly of the sides 12 and 14. The compartments 26 and 28 are spaced apart transversely of the hull 10 and define an aisle 30 therebetween whose lower extremity is defined by a lower walk deck 32. A helm 34 is disposed immediately rearward of the port compartment 26 and each compartment 26 and 28 includes an upper forward portion 36 which is inclined forwardly and downwardly toward the corresponding gunwale. An upper horizontal transverse structural member 38 extends between the upper portions of the compartments 26 and 28, although some hull constructions may not require the structural member 38, and a windshield assembly 40 is supported and projects upwardly from the compartments 26 and 28 rearwardly of the portions 36 thereof. Further, a seat structure 42 is disposed rearward of the compartments 26 and 28. The seat structure 42 may be of the split seat type in order to form a rearward extension of the aisle 30.

A rail structure including opposite side sections 44 and 46 and a forward transverse section 48 is provided with the rail sections 44 and 46 extending along and projecting upwardly above the gunwales 22 and 24, the section 48 of the rail extending between the forward ends of the sections 44 and 46 and being supported from the bow structure 18. The rear ends of the rails 44 and 46 are inclined rearwardly and upwardly as at 50 and define forward extension of the forwardly and downwardly inclined portions of the compartments 26 and 28.

The center of the structural member 38 is notched as at 52 and the center of the rail section 48 is notched as at 54. A center elongated support member 56 has its rear and front ends seated in the notches 52 and 54 and a flexible soft top cover referred to in general by the reference numeral 58 is disposed over the forward cockpit area 60 of the interior of the hull disposed forward of the compartments 26 and 28. The cover 58 includes a top panel 62 having rear and forward marginal portions 64 and 66 and the cover 58 additionally includes depending opposite side panels 68. The rear marginal portion of the panel 62 includes first snap fastener members 70 spaced therealong removably engageable with corresponding second snap fasteners 72 spaced along the compartments 26 and 28 immediately rearward of the forwardly and downwardly inclined portions 36 thereof. The lower marginal edges of the side panel 68 include snap fasteners 74 spaced therealong corresponding to the snap fasteners 70 and the rail sections 44 and 46 include snap fasteners 76 spaced therealong corresponding to the snap fasteners 72 whereby the cover 58 may be removably secured over the elongated support member 56 and to the upper portions of the compartments 26 and 28 as well as the rail sections 44 and 46, the lower marginal edges of the side panel 68 being rearwardly and upwardly inclined as at 78 to conform to the portion 36 and 50.

The walk deck 32 extends considerably forwardly of the compartments 26 and 28 and the hull 10 further includes a raised deck 80 extending between the sides 12 and 14 forwardly of the compartments 26 and 28 spaced below the gunwales 22 and 24. The raised deck 80 includes a rearwardly opening and vertically extending notch or recess 82 formed therein opening rearwardly into the aisle 30 and in vertical alignment with the walk deck 32 whereby opposite side portions of the raised deck 80 are disposed on opposite sides of the forward portion of the walk deck 32 and a forward portion of the raised deck 80 is defined forward of the forward extremity of the walk deck 32. The raised deck 80 may serve as a seating area for persons disposed about the forward end of the walk deck 32 and also as opposite side bunks. Still further, the peripheral portions of the raised deck defining the rearwardly opening vertically extending notch or recess therein is stepped as at 84 to receive a removable deck panel 86 whereby the forward portion of the walk deck 32 forward of the compartments 26 and 28 may be covered and a substantially planar and uninterrupted deck may be defined between the sides 12 and 14 forward of the compartments 26 and 28.

Each of the compartments 26 and 28 includes a horizontally swingable closure door 88 swingable into and out of closed position relative to an opening 90 formed in the corresponding compartment through which access may be had into the interior thereof from the aisle 30. A marine head or portable toilet may be enclosed within one of the compartments and the other compartment may be utilized as storage space.

Figure 8:
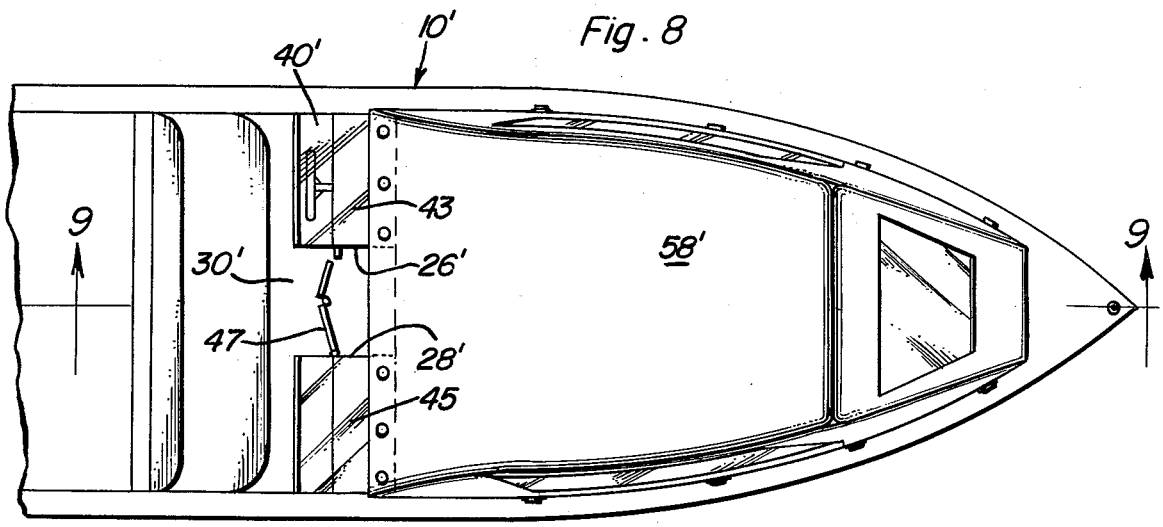
FIG. 8 is a fragmentary top plan view of a second form of boat hull constructed in accordance with the present invention and with a hard top cover secured over the forward cockpit portion of the hull.
Figure 9:
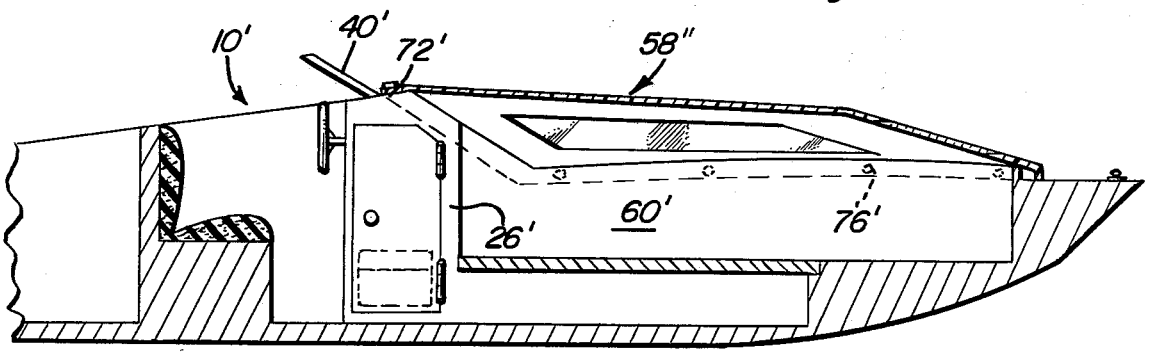
FIG. 9 is a longitudinal vertical sectional view taken substantially upon the plane indicated by the section line 9—9 of FIG. 8.
Figure 10:
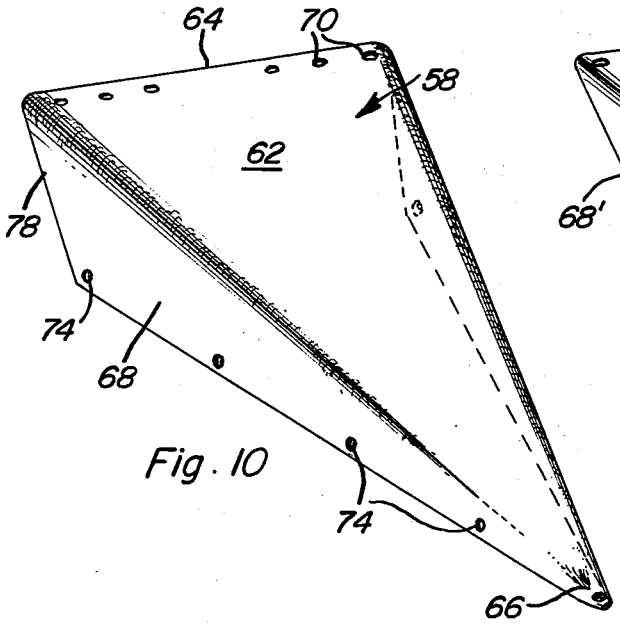
FIG. 10 is a perspective view of the soft top cover illustrated in FIGS. 4–7.
Figure 11:
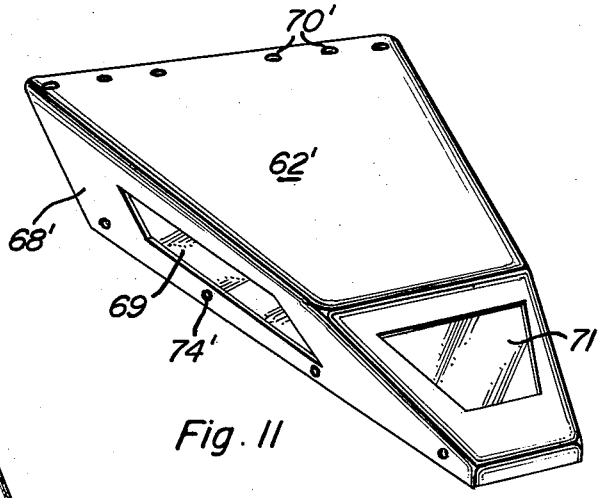
FIG. 11 is a perspective view of the hard top cover illustrated in FIGS. 8 and 9.

Referring now more specifically to FIGS. 8 and 9 of the drawings, the numeral 10′ generally designates a second form of hull constructed in accordance with the present invention. The hull 10′ is substantially identical to the hull 10 except that the windshield 40′ thereof corresponding to the windshield 40 does not include a center section corresponding to the center section 41 of the windshield assembly 40. Further, the hull 10′ does not include a structural member corresponding to the structural member 38, and the windshield 40′ includes opposite side sections 43 and 45 thereof supported from opposite side compartments 26′ and 28′ corresponding to the compartments 26 and 28. In addition, a double folding door 47 is hingedly supported from the compartment 28′ and may be utilized to close the aisle 30′ corresponding to the aisle 30.

In addition, the hull 10′ does not include a soft top such as the soft top cover 58. Rather, the hull 10′ includes a hard top cover referred to in general by the reference numeral 58′ including a top panel 62′ corresponding to the top panel 62 and depending side panels 68′ corresponding to the side panels 68. The side panels 68′ may include windows 69 and the forward portion of the top panel 62′ is inclined downwardly and may include a window 71. However, the cover 62′ includes fasteners 70′ and 74′ corresponding to the fasteners 70 and 74 and the hull 10′ includes fasteners 72′ and 76′ corresponding to the fasteners 72 and 76. Accordingly, the cover 62′ may be secured over the cockpit 60′ corresponding to the cockpit 60 in substantially the same manner that the cover 58 may be secured over the cockpit 60, except that the cover 62′ does not require the center longitudinal support member 56 provided with the cover 58.

The hulls 10 and 10′ may be constructed of conventional boat building materials and may be propelled with either outboard or inboard/outboard power.

It may be readily noted that the boat hull 10′ defines a "cuddy cabin" hull, although the cover 58′ may be readily removed in order to transform the hull 10′ into a "bowrider" or "fisherman" type of hull. Also, although the forward portion of the cockpit 60 enclosed by the cover 58 includes reduced head room as opposed to the head room provided by the cover 58′, the boat hull 10 defines a "cuddy cabin" hull when the cover 58 is in position. Of course, the boat hull 10 may also be transformed into a "bowrider" or "fisherman". The panel 86 serves a considerable purpose when the hull 10 is to be used as a "fisherman" type of hull inasmuch as a continuous forward deck for supporting fisherman is defined. In addition, the panel 86 is also useful when the hull 10 is to be used as a "cuddy cabin" type of hull.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A boat including a hull defining longitudinal upstanding opposite sides interconnected by a bottom extending between lower marginal edges of said sides and by a bow structure at their forward ends and a transom structure at their rear ends, a pair of spaced apart midship opposite side compartments immediately inwardly of said sides and defining a center longitudinal aisle therebetween, said sides terminating upwardly in generally horizontal gunwales, said compartments projecting appreciably upwardly above said gunwales and including forward upper portions inclined forwardly and downwardly toward said gunwales, a lower walk deck extending longitudinally of said hull between said compartments and appreciably forwardly of the latter, a raised deck above and below said walk deck and gunwales, respectively, extending between said sides forwardly of said compartments and forwardly from the latter toward said bow structure, said raised deck including a rearwardly opening vertical extending recess formed therein opening into said aisle between said compartments and in vertical registry with the forward portion of said walk deck extending forwardly of said compartments, the portion of the interior of said hull disposed between said compartments and said bow and between said opposite sides defining a forward cockpit, and a cover removably secured over said cockpit including a top panel and depending opposite side panels, said top panel including front and rear marginal edges, said side panels including forwardly and downwardly inclined rear marginal edges extending downwardly from adjacent ends of said rear marginal edge of said top panel, said inclined marginal edges being anchored relative to the corresponding portions of said forwardly and downwardly inclined compartment upper portions, said side panels including lower marginal portions anchored relative to the corresponding gunwale portions forward of said compartments and the forward marginal edges of said top panel being anchored relative to said bow structure.

2. The combination of claim 1 including a transverse upstanding windshield assembly supported from and projecting upwardly from the upper portions of said compartments disposed rearwardly of said forwardly and downwardly inclined portions thereof.

3. The combination of claim 1 wherein said top and side panels of said cover are constructed of flexible sheet material.

4. The combination of claim 1 wherein said top and side panels of said cover are rigid and joined together in fixed position relative to each other.

5. The combination of claim 6 including a helm disposed immediately rearward of one of said compartments.

6. The combination of claim 1 wherein said compartments include opposing upstanding inner sides disposed on opposite sides of said walk deck, one of said inner sides including a door opening therein opening into the corresponding compartment from said walk deck, and a horizontally swingable door operatively associated with said door opening for closing and opening the latter.

7. The combination of claim 1 wherein said rear and lower marginal edges of said top and side panels of said cover include first snap fastener means spaced therealong and said upper portions of said compartments and gunwales include second snap fastener means with which said first snap fasteners are removably engaged.

8. The combination of claim 1 wherein the upper portions of said compartments include rearwardly and upwardly inclined windshield sections supported therefrom.

9. The combination of claim 1 wherein the marginal portions of said raised deck defining said vertically extending and rearwardly opening recess are stepped, and a horizontal deck panel removably seated in said stepped marginal portions and coacting with said raised deck to define a full transverse raised deck between said compartments and said bow structure.

* * * * *